US006685283B2

(12) United States Patent
Gembar et al.

(10) Patent No.: US 6,685,283 B2
(45) Date of Patent: Feb. 3, 2004

(54) CABINET FOR DISPLAYING STRINGED MUSICAL INSTRUMENTS

(75) Inventors: Richard Gembar, Mt. Juliet, TN (US); Anthony W. Bragg, Nashville, TN (US)

(73) Assignee: Gibson Guitar Corp., Nashville, TN (US)

( * ) Notice: Subject to any disclaimer, the term of this patent is extended or adjusted under 35 U.S.C. 154(b) by 0 days.

(21) Appl. No.: 10/382,282

(22) Filed: Mar. 5, 2003

(65) Prior Publication Data

US 2003/0214202 A1 Nov. 20, 2003

Related U.S. Application Data

(60) Provisional application No. 60/380,899, filed on May 16, 2002.

(51) Int. Cl.[7] ..... A47F 3/00

(52) U.S. Cl. ..... 312/114; 248/443; 248/201; 248/176.1

(58) Field of Search ..... 312/114, 138.1, 312/245, 328; 84/327; 248/443, 201, 176.1

(56) References Cited

U.S. PATENT DOCUMENTS 1,313,498 A * 8/1919 Nason ..... 312/139.2
4,742,751 A * 5/1988 Cherry ..... 84/327
5,758,936 A * 6/1998 Baughan ..... 312/245
D418,347 S * 1/2000 Dragonette ..... D6/559
6,135,277 A * 10/2000 Armstrong ..... 206/314
6,281,417 B1 * 8/2001 Ladao ..... 84/327
6,462,260 B2 * 10/2002 Fediakov ..... 84/327
6,561,470 B1 * 5/2003 Gottfredson et al. ..... 248/201

* cited by examiner

*Primary Examiner*—Janet M. Wilkens
(74) *Attorney, Agent, or Firm*—Waddey & Patterson; Lucian Wayne Beavers

(57) ABSTRACT

A cabinet for display of a stringed musical instrument, wherein the stringed musical instrument is oriented horizontally and is held in place within the cabinet by the supports which engage the strap buttons of the instrument. The device is optionally attachable to a wall. In one embodiment, the supports are angled brackets with notches for receiving the strap buttons. A protective material is applied on each support and the interior surface of the cabinet to avoid abrasion of the instrument surface. The orientation of the angled brackets is such that the visible profile of the brackets is very small when an instrument is displayed in the cabinet.

20 Claims, 4 Drawing Sheets

CABINET FOR DISPLAYING STRINGED MUSICAL INSTRUMENTS

This application claims the priority benefits under Title 35, United States Code, §119(e) of U.S. Provisional Application Ser. No. 60/380,899 filed on May 16, 2002.

BACKGROUND OF THE INVENTION

The present invention relates generally to devices for the display of stringed musical instruments. The present invention more particularly relates to cabinets for display of stringed musical instruments and even more particularly relates to wall cabinets for the display of guitars.

Collectors and musicians frequently desire to display stringed musical instruments in manner that is both aesthetically pleasing and easy to access, yet reliably prevents damage to the instrument, such as scratching or marring of the hard lacquered surfaces of many instruments. One measure of the aesthetics of such a display device is the degree to which the supports of a display device are not visibly intrusive when holding an instrument for display. Thus a display device having instrument support structures that are highly visible to one viewing the display of the instrument may be considered less aesthetically pleasing than a display device having instrument supports that are not visible to the viewer. Correspondingly, one measure of ease of access is the number of discrete steps that must be taken to place or remove an instrument in a display device. The choices of collectors and musicians desiring to display stringed musical instruments in a horizontal orientation have previously been limited to selection among devices that compromise at least one of the above stated objectives.

For example, in displaying an electric guitar having strap buttons, the guitar may be suspended by a guitar strap attached to the guitar and suspended from a visually non-intrusive hanger mounted on a wall. This may be aesthetically pleasing, but the hanging of the guitar by its strap is problematic. A stable display is rarely achieved and the guitar may shift from the desired hanging position. Additionally, any shifting of a guitar so displayed may mar the lacquered surface of the guitar if it contacts nearby structures, such as a wall.

Some devices have solved the problem of unintended movement of the instrument by securing guitars in a horizontal display position with large clamps that grip the body of the guitar. While such a device effectively secures the guitar, the prominent visibility and complexity of clamps detract from both the aesthetics of the display and the ease of access to the instrument housed in the display device. Other devices employ stands with one or more large cradles, or the equivalent, into which a guitar may be laid. While being both somewhat more stable than a suspending guitar strap and having greater ease of access than a device using clamps, devices employing cradle-like features have the disadvantage of having an instrument support that is visually prominent enough to detract from the aesthetics of the display.

Currently there is need in the art for a cabinet suitable for housing and displaying string musical instrument, such as a guitar, in a horizontal orientation in manner that is both aesthetically pleasing and easy to access, yet reliably prevents damage to the instrument.

SUMMARY OF THE INVENTION

The present invention provides a cabinet for display of a stringed musical instrument, wherein the stringed musical instrument is oriented horizontally and is held in place within the cabinet by supports which engage the strap buttons of the instrument. The device is optionally attachable to a wall.

In one embodiment, the supports are angled brackets with notches shaped and sized for receiving the strap buttons. A protective material is applied on each support and the interior surface of the cabinet to avoid abrasion of the instrument surface. The orientation of the angled brackets is such that the visible profile of the brackets is very small when an instrument is displayed in the cabinet. As well, the instrument is firmly secured by placing its strap buttons in sized notches of the brackets.

Accordingly it is an object of the present invention to provide a display cabinet for holding a stringed musical instrument in manner that is aesthetically pleasing.

It is an additional object of the present invention to provide a display cabinet for holding a stringed musical instrument in manner that is easy to access.

It is a third object of the present invention to provide a display cabinet for holding a stringed musical instrument in manner that reliably prevents damage to the instrument.

Finally, it is an object of the present invention to provide a display cabinet for holding a stringed musical instrument in a horizontal orientation supported by the strap buttons of the instrument in manner that is both aesthetically pleasing and easy to access, yet reliably prevents damage to the instrument.

Other and further objects, features and advantages of the present invention will be readily apparent to those skilled in the art upon the reading of the following disclosure when taken in conjunction with the accompanied drawings.

DESCRIPTION OF THE PREFERRED EMBODIMENTS

Figure 4:
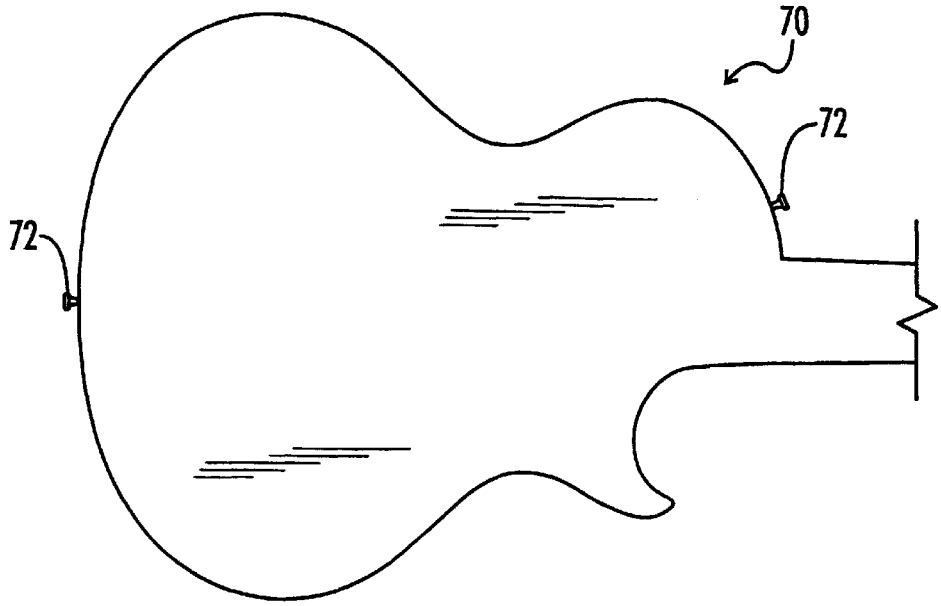
FIG. 4 is a front silhouette of a typical string musical instrument, an electric guitar, that would be supported in the cabinet of FIG. 1.

Referring now to the drawings, and particularly to FIG. 4, a front silhouette of a typical string musical instrument 70, is shown having two strap buttons 72 embedded within the body of the instrument. The apparatus of this invention for housing and displaying a stringed musical instrument 70 having at least two embedded strap buttons 72 incorporates features for suspending and housing the instrument 70 from strap buttons 72 in a horizontal orientation within the encasement of a cabinet described below.

Figure 1:
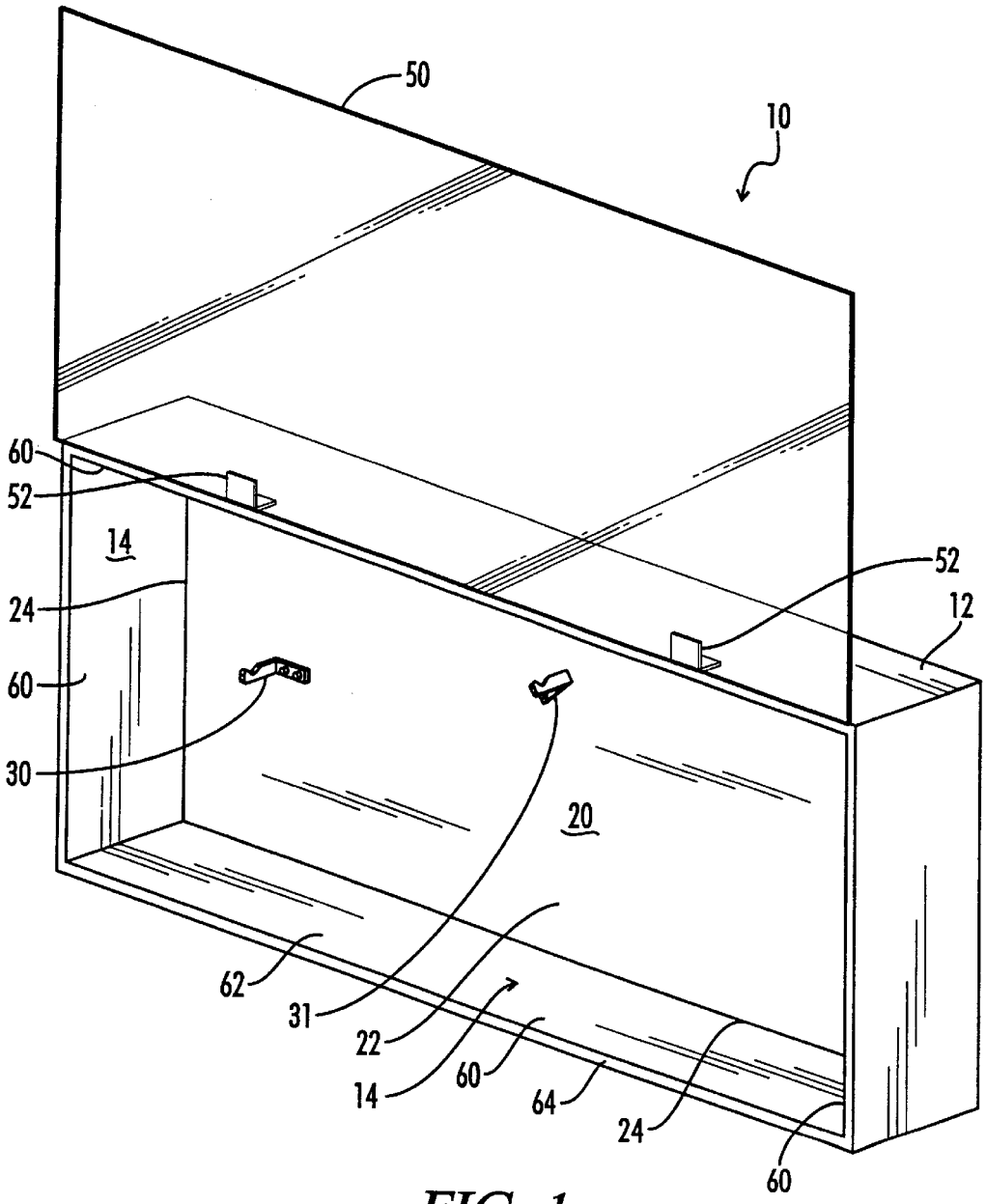
FIG. 1 is a front perspective of the cabinet of the present invention.

Referring now to FIG. 1, a cabinet for displaying a string musical instrument is shown and generally designated by the numeral 10. The cabinet 10 of the present invention includes a back 20 having a surface 22 and a perimeter 24. At least two hangers are attached to the back 20. The size and shape of the surface 22 of the back 20 is selected such that a string musical instrument 70 of the type desired to be displayed can be mounted in a horizontal orientation within the perimeter 24 of the back 20. In this embodiment, the cabinet 10 is shown having as hangers a left most angled bracket 30 and a right most angled bracket 31. Each angled bracket has a first leg 34, which is mounted to the surface 22 of the back 20, and has a second leg 35 extending outward from the surface 22. The second leg 34 of each angled bracket forms a support for receiving a strap button 72 of the string musical instrument 72.

Figure 2:
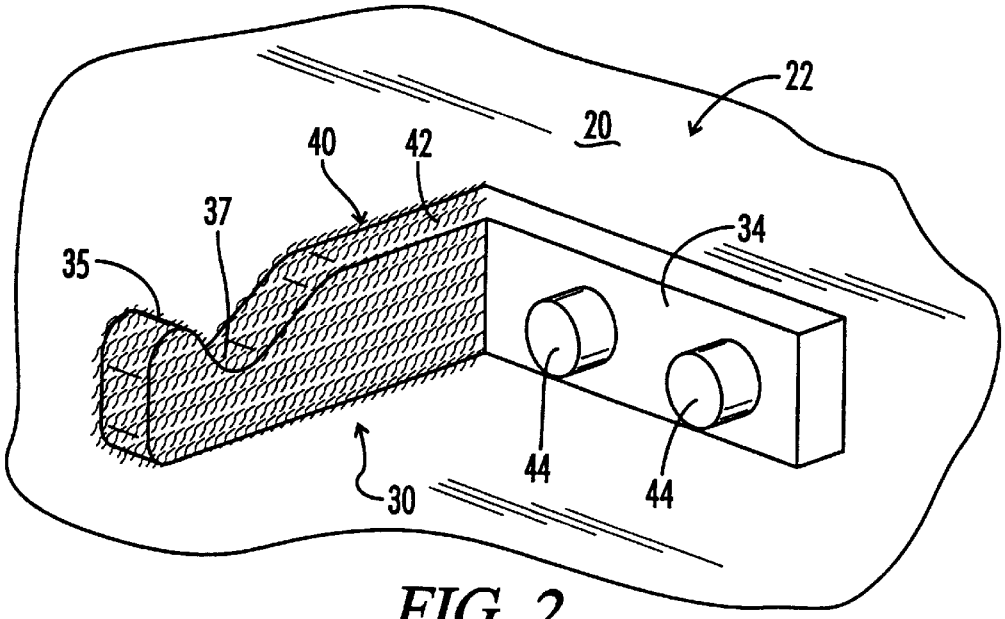
FIG. 2 is an enlarged view of the left bracket of the cabinet of FIG. 1.
Figure 3:
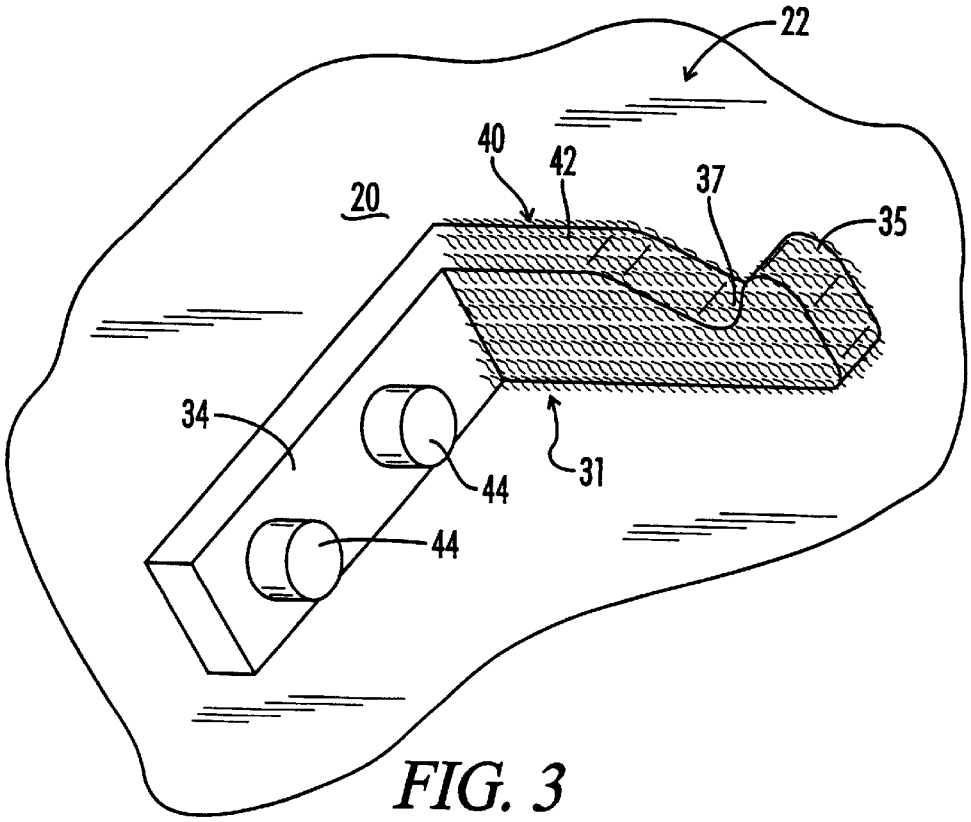
FIG. 3 is an enlarged view of the right bracket of the cabinet of FIG. 1.

Now referring to FIGS. 2 and 3 respectively, the left angled bracket 30 and the right angled bracket 31 of the cabinet 10 of FIG. 1 are shown in greater detail. In this embodiment, a notch 37 formed within the second leg 35 of each angled bracket comprises the supports for receiving a strap button 72. Each notch 35 is of such a size and shape as to securely receive and retain the strap button 72 of a string musical instrument. Referring again to FIG. 1, the left and right angled brackets 30, 31 are shown positioned upon and mounted to the back 20 so as to together securely receive and hold the strap buttons 72 of a string musical instrument 70 and display the string musical instrument 70 in a horizontal orientation.

One advantage of this embodiment is that the notching of the angled brackets provides for ease of access. The string musical instrument 70 can readily be placed in or removed from each notch 37 in a single step. Another advantage of this embodiment is that the notching of the angled brackets provides for reliably preventing damage to the string musical instrument 70 in that the string musical instrument 70 is firmly held within each notch 37 at two points on the string musical instrument 70, the two points being the two embedded strap buttons 72.

To prevent damage to the string musical instrument 70 displayed in the cabinet 10, non-abrasive materials 40 are applied such surfaces of the cabinet 10 that may contact the hard lacquer finishes of the string musical instrument 70. Now referring to FIGS. 1, 2 and 3, felt 42 is applied to the surface 22 of the back 20 and to each second leg 35 of the left and right brackets 30, 31. Also, resilient bumpers 44 are applied to each first leg 34 of the left and right brackets 30, 31. The felt 42 and resilient bumpers 44 cushion the string musical instrument 70 and prevent the surface the string musical instrument 70 from contacting any hard edges or rough surfaces of the cabinet 10.

Figure 6:
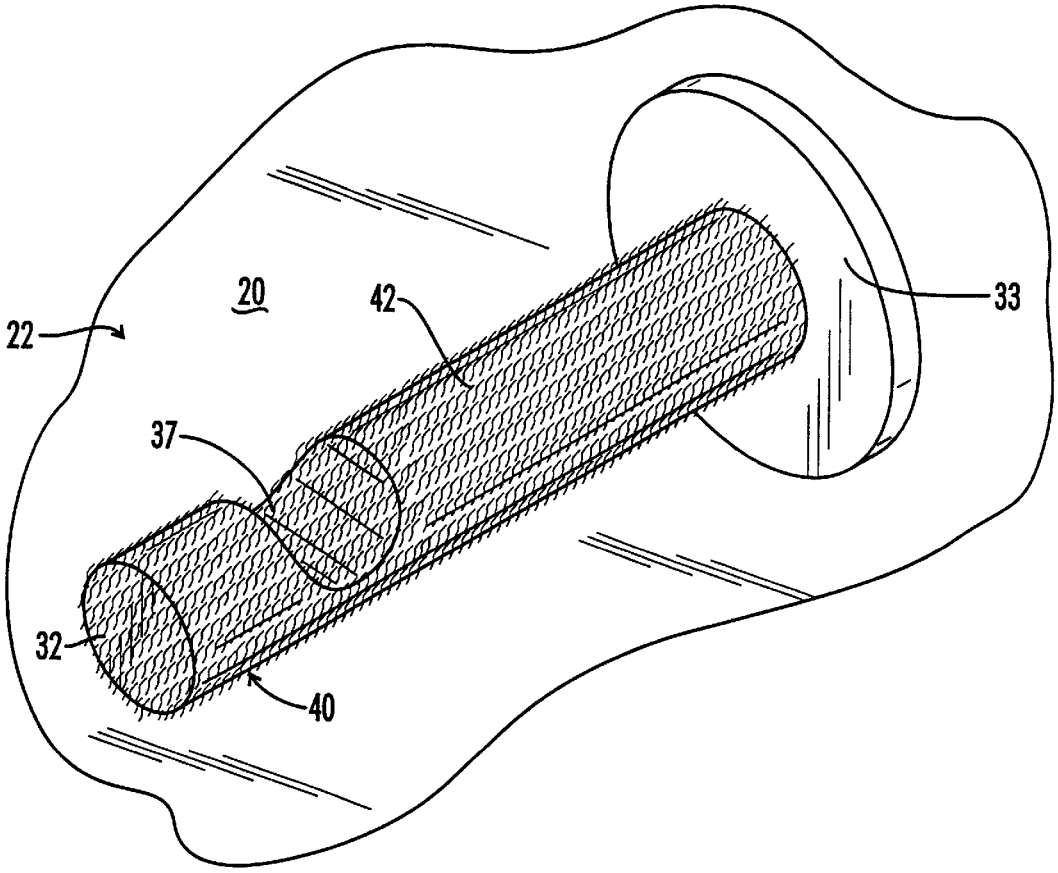
FIG. 6 is an enlarged view of the cabinet of FIG. 1, showing an alternate embodiment of the cabinet hanger.

Now referring to FIG. 6, details of an alternate embodiment of the cabinet 10 of FIG. 1 is shown herein. In this alternate embodiment one hanger utilized to support the strap buttons 72 of the string musical instrument 70 is shown as being a rigid bar 32 with a notch 37 defined therein and extending outward from the surface 22 of the back 20. The rigid bar 33 is shown with an optional mounting plate 33. A non-abrasive material 40 is applied to the rigid bar 33 to prevent marring and scratching the surface of the string musical instrument 70.

Again referring to FIG. 1, the cabinet 10 is further comprised of a cabinet box 12 for providing an enclosure for the displayed string musical instrument 70. The cabinet box 12 is shown having multiple panels 60 attached to the back 20 at the perimeter 24 of the back 20. The cabinet box 12 as depicted in FIG. 1 is a rectangular box sized to receive a typical string musical instrument 70 such as an electric guitar. However other sizes and shapes could be utilized. The interior surface 14 of the cabinet box is comprised of the surfaces of the back 20 and panels 60. Since the interior surface 14 of such a cabinet box 12 might scratch or mar the hard lacquer finish of a typical string musical instrument 70, non-abrasive materials 40 are applied the interior surface 14 of the cabinet box 12.

The cabinet 10 of FIG. 1 is also shown having a plate 50 attached to the edge 64 of the cabinet box 12 distal to the back 20. As shown herein, the plate 50 is transparent and is attached by hinges 52 for easy of access to the interior of the cabinet box 12. Numerous variations of the composition and characteristics of the plate may be utilized. For instance, the plate 50 may be trimmed in cabinetry material such as wood. Also, joining means other than hinges 52 may be used and the plate 50 may be attached to the cabinet box 12 at positions other than the distal edge 64 of a panel 60. Finally, the plate 50 may be divided into areas having varying degrees if transparency, translucence or opaqueness.

Figure 5:
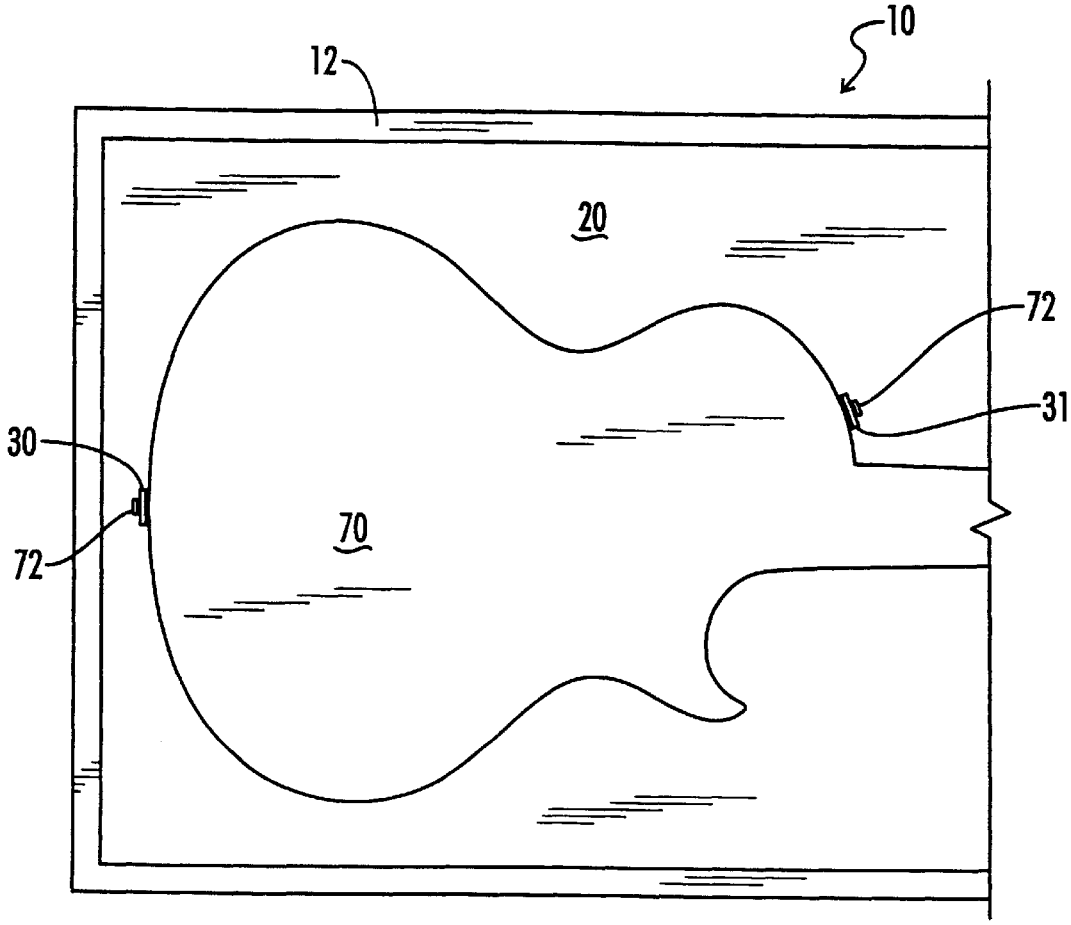
FIG. 5 is a front view of the guitar of FIG. 4 mounted horizontally in the cabinet of FIG. 1.

As stated above, a typical string musical instrument 70 for display in the cabinet 10 of the present invention is an electric guitar. FIG. 4 shows a silhouette of such a typical string musical instrument 70 having embedded strap buttons 72. FIG. 5 shows an embodiment of the cabinet 10 of FIG. 1 with the typical string musical instrument 70 of FIG. 4 displayed therein. The left and right angle brackets 30, 31 of the cabinet 10 securely receive and hold the strap buttons 72 and display the string musical instrument 70 in a horizontal orientation.

FIG. 5 illustrates a third advantage of the cabinet of this invention embodied in FIG. 1. The body of the guitar of FIG. 5 shields from the view of an observer the first leg 34 of each of the right and left angle brackets 30, 31. Also, the second leg 35 of each of the right and left angle brackets 30, 31 would be observed from an "end on" perspective and do not cover any of the front face of the guitar. These visual features provide an aesthetically pleasing means of display in that the support structures are visually nonintrusive.

Referring now to FIGS. 1–5, this embodiment discloses a display cabinet for holding a stringed musical instrument in manner that is aesthetically pleasing, is easy to access and reliably prevents damage to the instrument. Thus it is seen that the present invention readily achieves the ends and advantages mentioned as well as those inherent therein. While certain preferred embodiments of the invention have been illustrated and described for purposes of the present disclosure, numerous changes in parts and steps may be made by those skilled in the art, which changes are encompassed within the scope and spirit of the present invention as defined by the appended claims.

What is claimed is:

1. A cabinet for displaying a stringed musical instrument, the instrument having a plurality of strap buttons, said cabinet comprising:

a back having a flat surface and a perimeter; and a plurality of angled brackets each having a first leg, the first leg mounted to the flat surface of the back, and each having a second leg, the second leg extending outward from the flat surface and having a support for receiving a strap button, wherein the angled brackets are each mounted directly and separately on the back so as to jointly support the instrument through at least two of the said strap buttons.

2. The cabinet of claim 1 wherein each second leg of the plurality of angled brackets having a notch defined therein, such notch sized to receive a strap button.

3. The cabinet of claim 1 wherein the angled brackets support the instrument in a horizontal orientation.

4. The cabinet of claim 1 further comprising a non-abrasive material applied to at least one of said angled brackets.

5. The cabinet of claim 4 wherein the non-abrasive material comprises felt.

6. The cabinet of claim 4 wherein the non-abrasive material comprises at least one resilient bumper.

7. The cabinet of claim 1 further comprising a non-abrasive material applied to the flat surface of the back.

8. The cabinet of claim 7 wherein the non-abrasive material comprises felt.

9. The cabinet of claim 1 further comprising a plurality of side panels attached to the back at the perimeter of the back, said back and side panels defining a cabinet box.

10. The cabinet of claim 9 further comprising a transparent plate attached to at least one of said side panels at an edge distal to the back.

11. A cabinet for housing a stringed musical instrument, the instrument having a plurality of strap buttons, said cabinet comprising:

a cabinet box having a back and a plurality of sides for housing the instrument, said back and sides each having an interior surface cumulatively defining an interior surface of the cabinet box; and a plurality of hangers each mounted directly and separately to the interior surface of the cabinet box, and each hanger having a support for receiving a strap button, wherein the hangers support the instrument through at least two of the strap buttons.

12. The cabinet of claim 11 wherein each hanger further comprises a a rigid bar extending outward from the interior surface.

13. The cabinet of claim 12, each rigid bar having a notch defined therein, such notch sized to receive a strap button.

14. The cabinet of claim 11 wherein the hangers support the instrument in a horizontal orientation.

15. The cabinet of claim 11 further comprising a non-abrasive material applied to at least one of said hangers.

16. The cabinet of claim 15 wherein the non-abrasive material comprises felt.

17. The cabinet of claim 11 further comprising a non-abrasive material applied to the interior surface.

18. The cabinet of claim 17 wherein the non-abrasive material comprises felt.

19. The cabinet of claim 11 further comprising a transparent plate attached to at least one of said sides at an edge distal to the back.

20. A cabinet for displaying a stringed musical instrument, the instrument having two strap buttons, said cabinet comprising:

a back, said back having a flat surface and a perimeter;

a plurality of side panels, each said side panel attached to the back at the perimeter of the back, said back and side panels defining a cabinet box;

two angled brackets, each said angled bracket having a first leg, each said first leg rigidly mounted to the flat surface of the back, and each said angled bracket having a second leg, each said second leg extending outward from the flat surface and having a notch defined therein, each such said notch sized to freely receive a strap button;

a non-abrasive material, said non-abrasive material applied to the flat surface and to each said second leg; and a plurality of resilient bumpers, at least one said bumper applied to each said first leg, wherein, the two angled brackets are each mounted directly and separately on the back so as to jointly support said instrument in a horizontal orientation through said two strap buttons.

* * * * *